United States Patent [19]

Kutz et al.

[11] Patent Number: 4,492,105

[45] Date of Patent: Jan. 8, 1985

[54] TIGHTENING DEVICE FOR THE GRIPPING JAWS OF A PLATE STRETCHER

[75] Inventors: Heinrich Kutz, Neuss; Gunter Ostlinning, Dusseldorf; Gerd Jung, Koblenz, all of Fed. Rep. of Germany

[73] Assignee: SMS Schloemann-Siemag Aktiengesellschaft, Dusseldorf, Fed. Rep. of Germany

[21] Appl. No.: 358,242

[22] Filed: Mar. 15, 1982

[30] Foreign Application Priority Data

Mar. 21, 1981 [DE] Fed. Rep. of Germany ..... 3111140

[51] Int. Cl.[3] ..... B21D 11/02

[52] U.S. Cl. ..... 72/302; 72/422

[58] Field of Search ..... 72/290, 301, 302, 422; 73/859

[56] References Cited

U.S. PATENT DOCUMENTS

| | | | |
|---|---|---|---|
| 1,496,137 | 6/1924 | Sundh | 72/290 |
| 2,164,343 | 7/1939 | Nighthart | 72/302 |
| 3,051,217 | 8/1962 | Hill et al. | 72/302 |
| 3,082,809 | 3/1963 | Petsch et al. | 72/302 |
| 3,349,598 | 10/1967 | Pollak | 72/302 |
| 3,440,856 | 4/1969 | Hoffmann et al. | 72/302 |
| 4,453,394 | 6/1984 | Just | 72/302 |

FOREIGN PATENT DOCUMENTS

| | | | |
|---|---|---|---|
| 562350 | 6/1977 | U.S.S.R. | 72/302 |
| 724241 | 3/1980 | U.S.S.R. | 72/302 |
| 778865 | 11/1980 | U.S.S.R. | 72/302 |

*Primary Examiner*—Lowell A. Larson

*Attorney, Agent, or Firm*—Holman & Stern

[57] ABSTRACT

A tightening device for the gripping jaws of a plate stretcher comprises one push rod for each pair of gripping jaws sliding in guides in the gripping head in the stretching plane, and having hinged thereto two link rods which are also hinged to the gripping jaws, the gripping jaw moving synchronously rearwards for the closing operation and forwards for the opening operation, in two guides disposed in V-formation to each other. The link rods are coupled to the gripping jaws in a disengageable manner to avoid damage to the link rods and tightening device if tearing of the plate takes place during the stretching operation, or on account of any difference in the gripping of the plate by the upper and lower gripping jaw causing generation of very large but different forces on the two link rods. The link rods are in the form of angle levers each having a long and short arm pivotally connected to the hydraulically mobile push rod. Each short arm is pivotally connected to a separate hydraulic cylinder disposed on the push rod, and the long arm is releasably coupled by way of mouth-shaped openings to entrainment cams on the gripping jaws so that they can be uncoupled therefrom by swivelling.

11 Claims, 13 Drawing Figures

TIGHTENING DEVICE FOR THE GRIPPING JAWS OF A PLATE STRETCHER

BACKGROUND OF THE INVENTION

1. Field of the Invention

The invention relates to a tightening device for the gripping jaws of a plate stretcher, comprising, per pair of gripping jaws, one hydraulically slidable push rod on which there are swivel-mounted two link rods which are each hinged to one gripping jaw, and these gripping jaws move synchronously forwards for closing and backwards for opening in two guides disposed in V formation relative to each other.

2. Description of the Prior Art

Hydraulic tightening devices are used for pressing the gripping jaws against the plate to be gripped, in which a hydraulic cylinder is connected to a push rod on which there are hinged two rods which themselves are connected by joint bolts to two opposing gripping jaws guided in guides of V formation. This is necessary in order to ensure synchronous sliding of the two opposing gripping jaws. This tightening device operates under the following conditions:

1. If the plate becomes torn, the gripping jaws experience a reaction due to the torn plate, which imparts a temporary acceleration to the gripping jaws of more than 100 g. Because of the inertia of the mass of the tightening device, very high forces arise in the connection bolts, which can lead to damage to the hinges.

2. It happens that the toothed gripping surfaces of the gripping jaws, and particularly the lower gripping jaw, become partly covered by shaved-off pieces of the stretched plates, thus resulting in a considerable reduction in the friction coefficient, i.e. the plate is gripped initially or mainly only by one gripping jaw, whereas the other gripping jaw remains behind or falls back. Thus because of the different gripping jaw movement, opposing high forces arise in the rods, which frequently lead to damage of the tightening device.

In addition, wrinkle formation or tearing occur in the plate to be stretched, i.e. the plate either cannot be used or must be newly straightened, heat-treated and stretched.

In order to prevent damage in these two cases, spring elements have been inserted into the joints between the push rods and the two link rods. By this means, in case 1, the mass of the accelerated rod is indeed reduced, but not eliminated. Experience shows that even with this solution, the joint bolts must be very frequently replaced due to deformation. The high spring force required because of the necessary pressing force and the large spring deflection required in case 2 considerably limit the effectiveness of this measure, both in case 1 and in case 2. This measure is also made more difficult by the fact that such devices are accessible only with great difficulty, and long idle periods must be assumed in the case of trouble.

BRIEF SUMMARY OF THE INVENTION

The object of the invention is therefore to provide a device in which

1. The high acceleration forces in the rod of the tightening device are prevented, 2. In the case of unequal friction coefficients at the gripping surfaces, the leading gripping jaw can exert no destructive force on the rod, 3. The accessibility to the joint between the link rod and gripping jaw is improved, and the susceptibility to trouble in the region of the joint between the push rod and link rods is reduced, 4. A device is provided which indicates when there is any lead of one gripping jaw relative to the other, and if the degree of lead exceeds a determined value, cuts out the stretching cylinder in order to prevent any damage to the plate to be stretched.

This object is attained according to the invention in that in the case of the initially described tightening device, the link rods are connected to the gripping jaws in a disengageable manner.

For this purpose, according to a further characteristic of the invention, the link rods are in the form of angle or crank levers with their fulcrum at the push rod hinge, the long lever arms of the angle levers comprising mouth-shaped openings at their free end, and the gripping jaws comprising entrainment cams which engage in the openings, and the short arms of the angle levers are each hinged independently of each other by way of tie rods to a respective hydraulic cylinder disposed on the push rod.

Because of the fact that the link rods are in the form of angle levers, the long arms of the angle levers can be released from the gripping jaw entrainment cams by swivelling them by loading the hydraulic cylinder. By this means, if the plate to be stretched is ripped, the acceleration force is no longer transmitted from the gripping jaws to the angle lever-shaped link rods, and consequently to the pivot of these levers.

According to a further characteristic of the invention, deflection plates are selectively disposed at the rear of the gripping jaws and/or on the base of the gripping head mouth. These deflection plates, which are replaceable, now absorb the mass of the gripping jaws which becomes released during the stretching operation if the plate is ripped. Because of the fact that the arm of the angle lever becomes uncoupled from the gripping jaws, the rebound velocity is much higher than in the case of the fixed connection between the gripping jaws and link rods which has been known up to the present time, in which the recoil was damped by clyinders by way of the fixed link rods, but serious danger to the rod and its joints still existed.

According to a further characteristic of the invention, the long arms of the angle levers comprise flat sliding surfaces on the same side as the mouth-shaped openings. By this means, the entrainment cams of the gripping jaws can slide on these surfaces if the push rod with the unengaged angle levers has moved further forwards and the ends of the angle levers lie between the gripping jaws.

According to a further characteristic of the invention, the mouth-shaped openings comprise sliding surfaces, and the angle $\alpha$ between the peripendicular to this sliding surface and the connection line between the mouth-shaped opening and the fulcrum of the angle lever is 40°–60°.

If one of the two gripping jaws remains behind the other on tightening and stretching the plate, the angle lever connected to the lagging gripping jaw by way of the coupling is forcefully thrust, with the other gripping jaw being simultaneously pulled forwards by the plate to be stretched. In order to enable the angle lever coupled to the forward gripping jaw to move aside due to the fact that it is in danger by virtue of high traction force, the mouth-shaped opening of the angle level is provided with a sliding surface in such a position that the angle $\alpha$ is substantially greater than the angle of friction $\rho_1$.

According to a further characteristic of the invention, the tie rods between the short arms of the angle levers and the hydraulic cylinders are provided with guide pulleys, about which there is led a cable, one end of which is fixed to the push rod and the other end to a spring element, the spring element being operationally connected to a potentiometer or a limit switch.

During the build-up of the stretching force, this measuring device indicates any lead of one of the two gripping jaws, and by way of the potentiometer or limit switch issues a signal for switching off the stretching operation, when a determined difference in the lead between the gripping jaws is exceeded. This provides further protection for the plate to be stretched and for the tightening device.

BRIEF DESCRIPTION OF THE DRAWINGS

The structure and operation of one embodiment of the invention is described in detail hereinafter with reference to the accompanying drawings, wherein.

DETAILED DESCRIPTION

Figure 1:
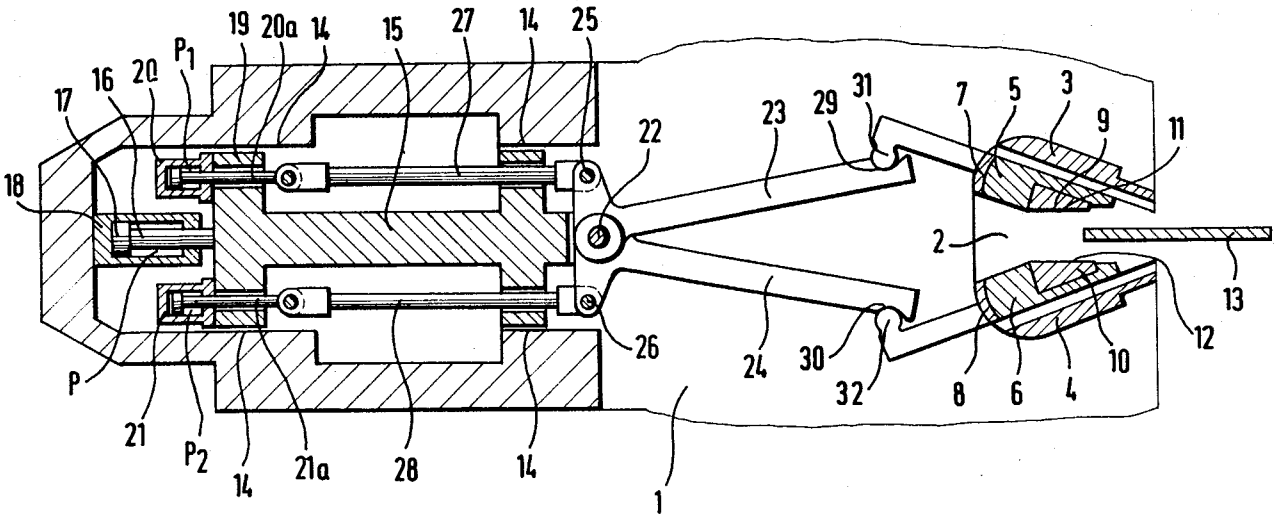
FIG. 1 is a cross-sectional view through the tightening device in its normal position.

In a gripping head 1 of a plate stretcher, which is not shown in greater detail, there is provided a gripping head mouth 2 in which gripping jaws 5, 6 are slidably guided in guides 3, 4. At the rear ends of the gripping jaws 5, 6 there are disposed striker plates 7, 8. These striker plates can also be provided on the base of the gripping head mouth 2. Gripping wedges 9, 10 are provided on the gripping side of the gripping jaws 5, 6, and their toothed surface 11, 12 grips a plate 13 to be stretched.

In order to slide the gripping jaws 5, 6 in their mutual V-formation guides 3, 4 so that they grip the plate 13 to be stretched, a push rod 15 sliding in guides 14 is provided in the gripping head 1 along the stretching axis. The push rod 15 is connected by way of a piston rod 16 and piston 17 to a hydraulically fed sliding cylinder 18, which is fixed to the gripping head 1. Hydraulically operated swivel cylinders 20, 21, which operate independently of each other, are disposed on a rear cross member 19 of the push rod 15, respectively above and below the stretching axis.

A push rod hinge 22 acting as a pivot for link rods in the form of angle levers 23, 24 disposed on the push rod hinge, is provided at the front end of the push rod 15. The angle levers 23, 24 are each joined with their short arm by means of connecting hinges 25, 26 to tie rods 27, 28, which are hinged to the piston rods 20*a*, 21*a* of the swivel cylinders 20, 21. The angle or crank levers 23, 24 are each provided at the free end of their long arm, which stretch in the direction of the gripping jaws 5, 6, with a mouth-shaped opening 29, 30. Entrainment cams 31, 32 fixed to the rear of the gripping jaws 5, 6 engage in these mouth-shaped openings 29, 30.

The sliding cylinder 18 comprises cylinder compartments 33 and 34. The cylinder compartments of the upper swivel cylinder 20 are indicated by the reference numerals 35 and 36, and the cylinder compartments of the lower swivel cylinder 21 are indicated by 37 and 38.

On the same side as the mouth-shaped openings 29, 30, the long arms of the angle levers 23, 24 comprise flat sliding surfaces 39, 40, on which the entrainment cams 31, 32 can slide. The mouth-shaped openings 29, 30 also comprise special slide surfaces 41 and 42, on which the entrainment cams 31, 32 under certain conditions can slide out of their engagement with the mouth-shaped openings 29, 30.

The operation of the tightening device is described in detail hereinafter with reference to normal operation and to disturbed operation.

The basic idea of the invention is that during the operating stage in which there is the danger of the plate becoming torn, i.e. when the stretching force F rises more than about 50% of the rated or nominal value, the tightening device is disengaged from the gripping jaws.

This is attained in that the angle levers 23 and 24 are able to be swivelled about the push rod hinge 22 by means of separate independently operating cylinders 20 and 21, by way of tie rods 27 and 28 and connecting hinges 25 and 26, and the connecting hinges between the angle levers and gripping jaws are releasable in the form of entrainment cams 31 and 32 on one side and mouth-shaped openings 29 and 30 on the other side. The normal position before sliding in a plate 13 to be stretched is the coupled position of the angle levers 23 and 24, with the gripping jaws 5 and 6 drawn back, i.e. the pressure in the cylinder compartments 36 and 38 of the swivel cylinders 20 and 21 is $p_1$ and $p_2$, and the pressure in the cylinder compartment 34 of the sliding cylinder 18 is p.

The push rod 15 is guided in the normal manner in guides 14 in the gripping head 1, and is connected to the piston rod 16 of the sliding cylinder 18, which is fixed in its turn to the gripping head 1. The gripping jaws 5, 6 disposed in the gripping head mouth 2 and guided in the gripping jaw guides 3 and 4 of hammer-head type lie by way of their deflection plates 7 and 8 against the base of the gripping head mouth 2 (FIG. 1)(initial or normal position).

Figure 2:
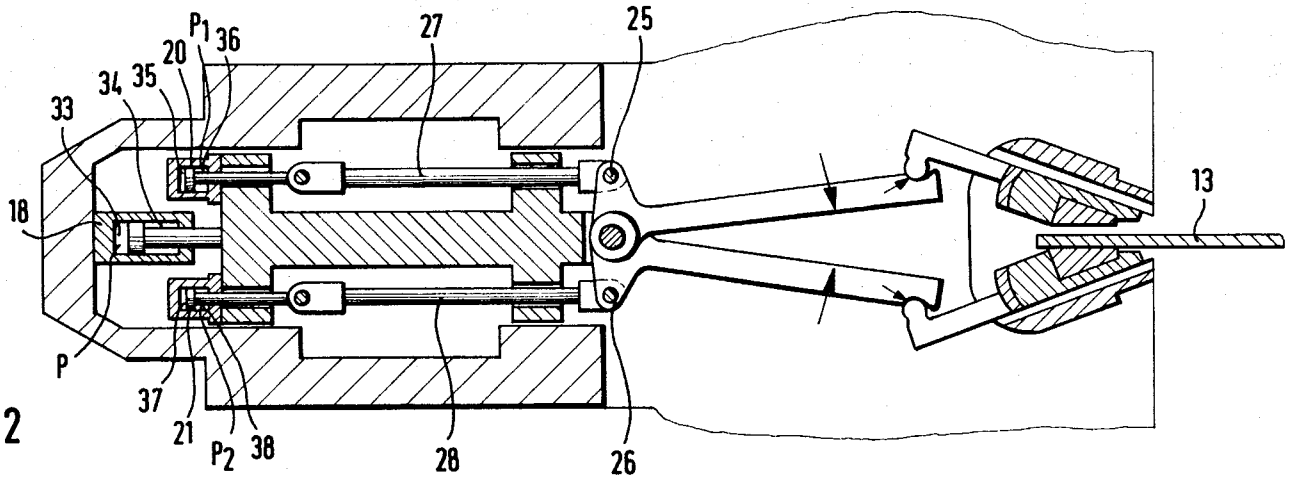
FIG. 2 is a view similar to FIG. 1 showing the tightening device during the gripping operation.

After sliding in the plate 13 to be stretched, the cylinder compartment 34 is unloaded, and the cylinder compartment 33 is loaded with a pressure p. The push rod 15 then moves forward, and slides the gripping jaws 5 and 6 forward by way of the angle levers 23 and 24, by which the angle levers swivel slightly inwards corresponding to the V arrangement of the gripping jaw guides 3 and 4, and force hydraulic oil out of the cylinder compartments 36 and 38 by pulling on the tie rods 27 and 28, which are hinged to the piston rods of the swivel cylinder 20 and 21 (FIG. 2).

Figure 3:
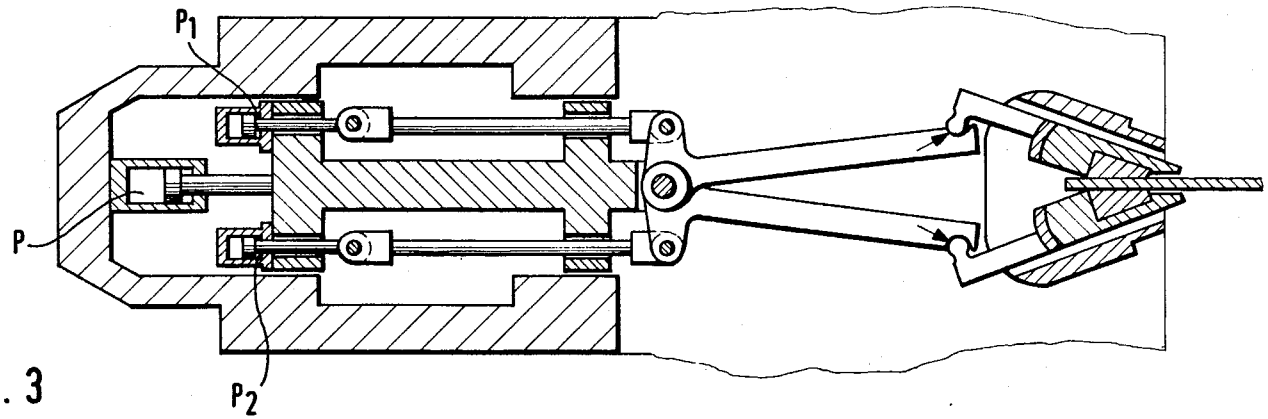
FIG. 3 is a view similar to FIG. 2 showing the tightening device in the gripped position.
Figure 3A:
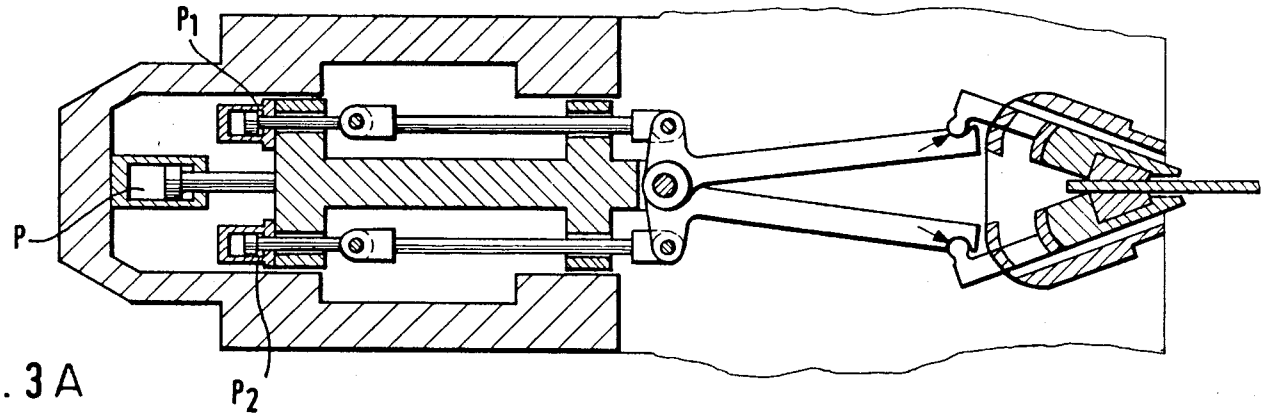
FIG. 3*a* is a partial view similar to FIG. 3 showing a different embodiment of deflection plates.

By virtue of the sychronous movement of the two gripping jaws 5 and 6, the plate 13 lying for example on the gripping surface 12 of the lower gripping jaw 6 is necessarily lifted into the middle of the gripping head, until both gripping surfaces 11 and 12 press against the surface of the plate (FIG. 3).

The pressing force produced by the sliding cylinder 18 enables the teeth of the gripping surfaces 11 and 12 to be forced so far into the plate material that when the pulling force F is subsequently induced in the plate 13, the frictional connection by way of the teeth of the gripping surfaces 11 and 12 is so great that the gripping jaws 5 and 6, initially supported by the sliding cylinder 18, are further drawn into the V-formation gripping jaw guides 3 and 4, and the teeth of the gripping surfaces 11 and 12 are able to press deeper into the plate.

Figure 4:
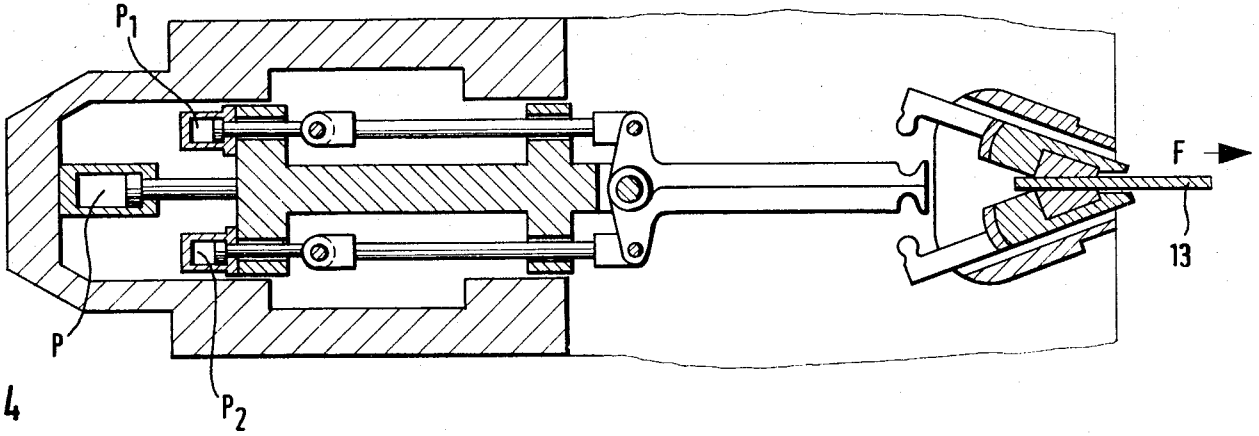
FIG. 4 is a view similar to FIG. 3 showing the tightening device towards the end of the stretching operation.

As the traction force F further increases, support by the sliding cylinder 18 is no longer necessary, and the cylinder compartment 33 can be unloaded, after which by unloading the cylinder compartments 36 and 38 and loading the cylinder compartments 35 and 37 of the swivel cylinders 20 and 21, the angle levers 23 and 24 are swivelled inwards, i.e. disengaged, the push rod 15 then being moved forward into its end position with the aid of the sliding cylinder 18 (FIG. 4).

Figure 7:
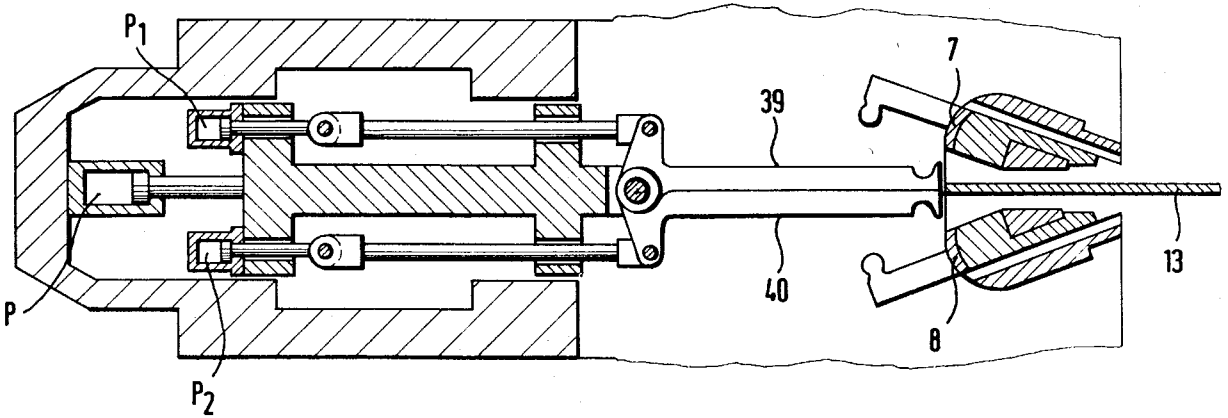
FIG. 7 is a view similar to FIG. 4 showing the tightening device after a plate tear.

If before reaching the predetermined rated stretching force there occurs a tear in the plate, which generally takes place suddenly, the plate flies in the direction of the base of the gripping head opening 2 with the kinetic energy which was stored in the elastic deformation of the torn-off piece of the plate 13 before its tearing, and is received thereat (FIG. 7). During this, the gripping jaws 5 and 6 are likewise accelerated in the rearward direction, until the teeth of the gripping surfaces 11 and 12 come loose. This takes place under a stretching force F which lies only slightly below the predetermined stretching force, in a stage in which the angle levers 23 and 24 are already uncoupled, i.e. the tightening device remains unaffected by the reaction of the gripping jaws 5 and 6. The gripping jaws 5 and 6 strike with high energy against the base of the gripping head mouth 2. During this, they can be flung to and fro, by which the energy is dissipated by the deformation of the replaceable deflection plates 7 and 8 and the surface of the plate 13. The deflection plate can be fixed selectively on the gripping jaws 5 and 6 or on the base of the gripping head mouth 2.

Figure 5:
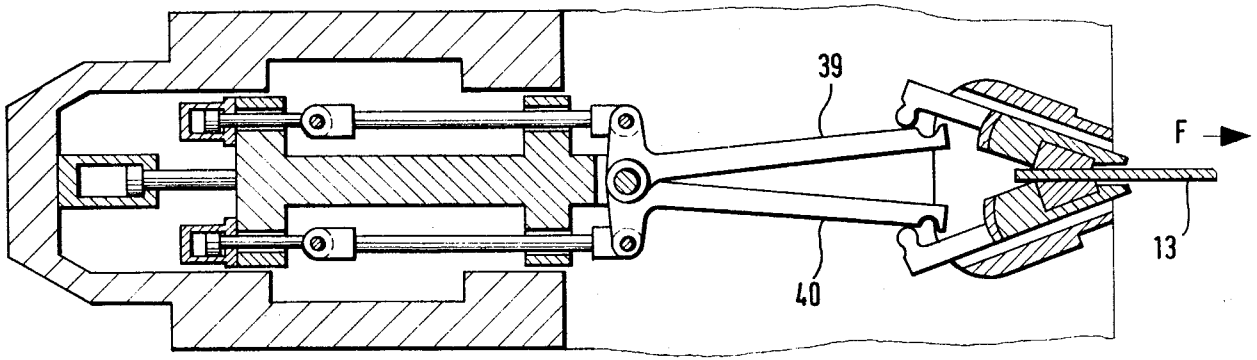
FIG. 5 is a view similar to FIG. 4 showing the tightening device after the end of the stretching operation.
Figure 6:
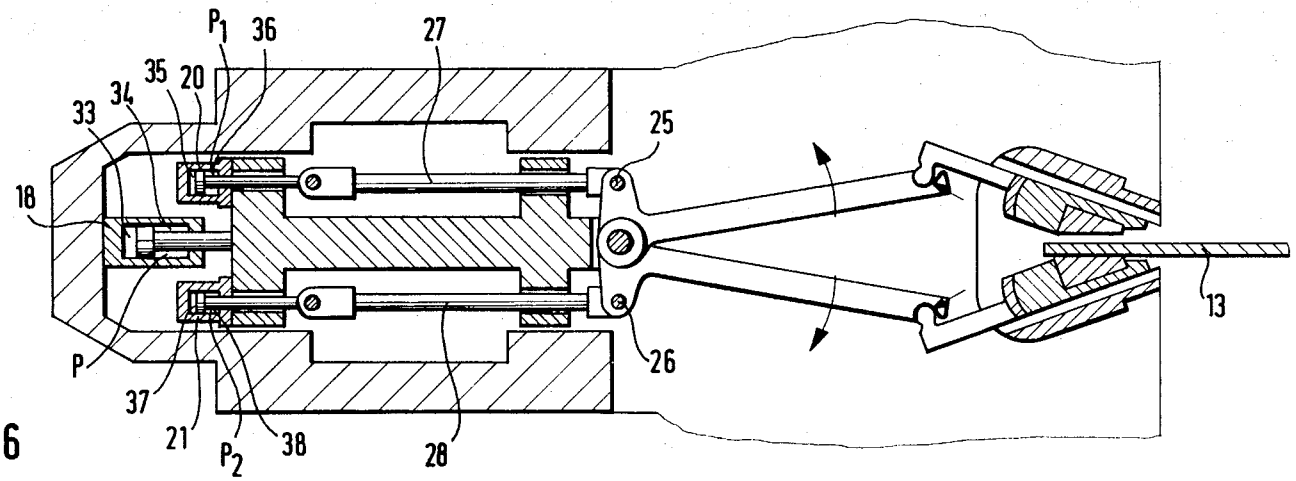
FIG. 6 is a view similar to FIG. 5 showing the tightening device during the withdrawal of the gripping jaws.

After a normal stretching operation, the stretching force is eliminated and the gripping head is moved partly forwards, after which the cylinder compartments 35 and 37 of the swivel cylinder 20 and 21 are unloaded and the cylinder compartments 36 and 38 loaded, i.e. the angle levers 23 and 24 are swivelled outwards by way of the tie rods 27 and 28, whereupon their sliding surfaces 39 and 40 strike against the entrainment cams 31 and 32 of the gripping jaws 5 and 6, these cams lying in an undefined position (FIG. 5). On subsequent withdrawal of the push rod 15 by switching-over the sliding cylinder 18, the mouth-shaped openings 29 and 30 of the angle levers 23 and 24 engage independently of each other with the entrainment cams 31 and 32, and pull the gripping jaws further into their normal position (FIGS. 6 and 1).

Figure 8:
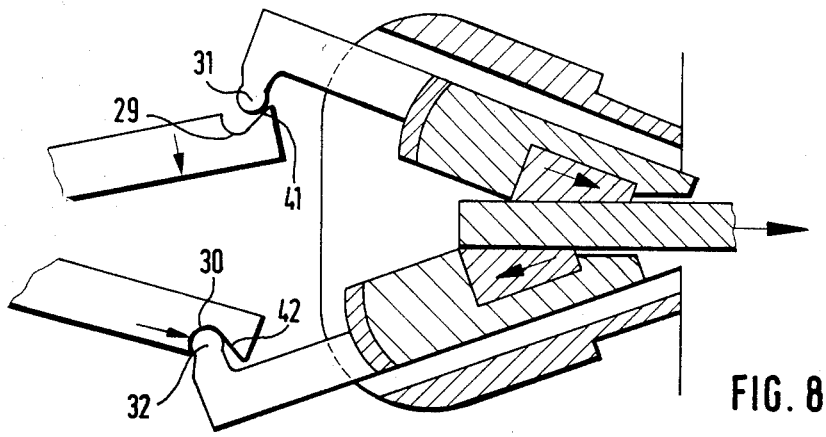
FIG. 8 is a partial enlarged cross-sectional view through the tightening device showing the upper gripping jaw leading.
Figure 9:
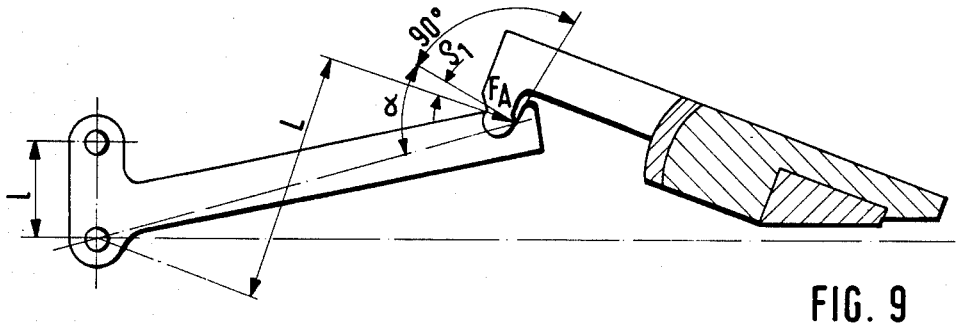
FIG. 9 is a partial cross-sectional enlarged view of the upper gripping jaw showing the effective forces when the upper gripping jaw is leading.
Figure 10:
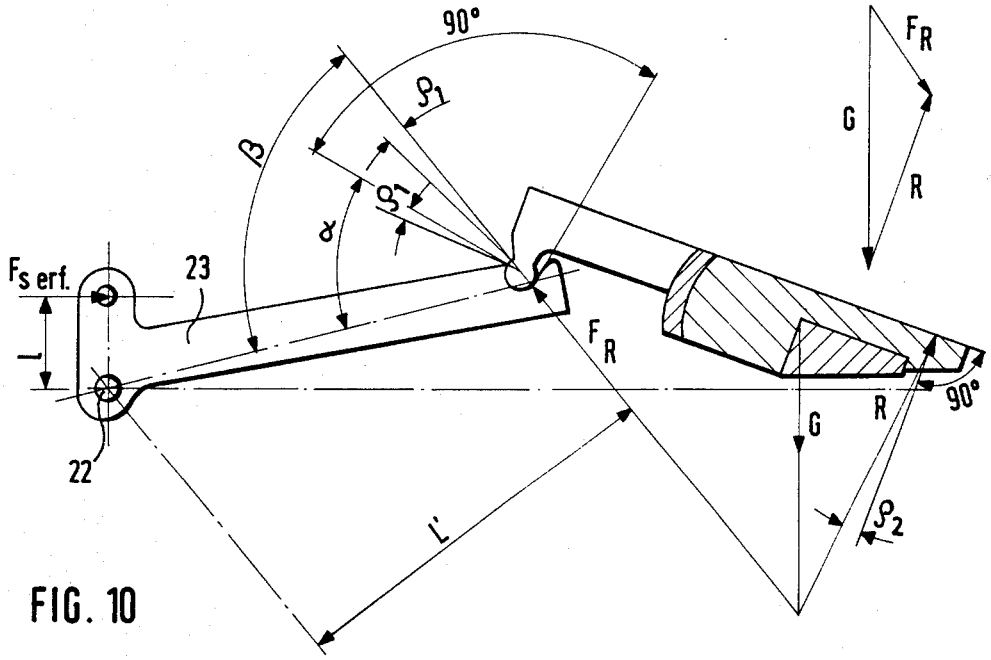
FIG. 10 is a view similar to FIG. 9 showing the effective forces during the withdrawal of the upper jaw.

In the case of different penetration of the teeth of the gripping surfaces 11 and 12 into the plate 13 during the tightening procedure on account of shavings from the plate material attaching to the gripping surfaces, and in particular the gripping surface 12 of the lower gripping jaw 6, the lower angle lever 24 becomes forceably pushed or even pushed back, and the upper gripping jaw 5 is pulled forwards through the plate 13 under uncontrolled high force. In order in this case to enable the angle lever 23, which is in danger from the high force, to move away, both the mouth-shaped opening 29 of the angle lever 23 and the mouth-shaped opening 30 of the lower angle lever 24 is provided with a sliding surface 41 and 42 respectively (FIG. 8), of such a length that the angle $\alpha$ (FIG. 9), between 40° and 60° greater than the angle of friction $\rho_1$. The occurring force $F_A$ then has a maximum value of Fs 1/L, where Fs is the traction force of the swivel cylinder 20 connected to the angle lever, for an overflow pressure of $p_1$. On the other hand, the angle $\alpha$ is substantially smaller than the angle $\beta$ (FIG. 10), so that when the upper gripping jaw 5 is withdrawn, the angle lever 23 does not move away under the force $F_R$, i.e. it does not slide away by way of its opening 29 from the cam 31 of the gripping jaw 5. The angle $\beta$ is the angle which lies between the direction of the force vector $F_R$ and the connection line between the mouth-shaped opening 29 and the fulcrum 22 of the angle lever 23. $F_R$ is the force vector associated with pulling back the gripping jaw 5, and deriving from its own weight G and the guide bearing force R.

As a further measure for protecting the plate to be stretched, on each tightening device there is installed a measuring device (FIGS. 11*a* and 11*b*) which during the stage in which the stretching force is being built up gives warning of any lead of one of the gripping jaws, and gives a signal for stopping the stretching operation if a determined value is exceeded.

For this purpose, the tie rods 27 and 28 and push rod 15 are provided with guide pulleys. A traction cable 43 is fixed at one end 43*a* to the push rod 15 and at the other end 43*b* in a spring element 44 disposed on the push rod 15. The spring element 44 acts on a lever 45 of a potentiometer 46. The traction cable 43 is guided over guide pulleys 47 and 48 mounted on separate tie rods, and 49 and 50 mounted on the push rod. The path taken by the traction cable 43 around the guide pulleys 49 and 50 is such that the spring element 44 and potentiometer 46 can be disposed in a position accessible from the outside. A limit switch can be used instead of the potentiometer 46 and lever 45.

We claim:

1. In a plate stretcher comprising a gripping head having a gripping mouth, at least one pair of plate-gripping jaws in the mouth, V-form guide means in which the jaws are movable, and means for moving the jaws relative to the guide means synchronously forwards for closing the jaws and backwards for opening the jaws, the improvement wherein the means for moving the jaws comprise, for each pair of jaws, a respective push rod, drive means operatively connected to said push rod for advancing and retracting said push rod, two links pivotally connected to the push rods, means to releasably pivotally connect each link to a respective jaw of said pair of jaws, so that each link may be coupled to a respective jaw for advancing and retracting said jaw by the push rod and may be uncoupled during the course of operation of the plate stretcher from said jaw for separate and independent movement of said link and jaw, and link operating means for moving said links between a first position wherein said links are coupled to respective jaws and a second position wherein said links are uncoupled from respective jaws and clear of the region of movement of each jaw.

2. The improvement according to claim 1 wherein each link comprises a crank lever having a long and short arm extending at an angle with respect to each other pivotably mounted at the junction of said arms on the push rod, said means to releasably pivotally connect each link to the respective jaw comprises a free end on each long lever arm, a mouthlike opening adjacent said free end, and a cam member on each jaw releasably engageable in said opening of the corresponding crank lever arm, and said link operating means comprises a separate respective drive means for each crank lever mounted on said push rod and means to independently pivotally connect said separate drive means to said short lever arm of a respective crank lever.

3. The improvement according to claim 2 and further comprising a flat sliding surface on the same side of each long arm as said mouth-like opening and disposed between said opening and the pivotal mounting of said lever to said push rod.

4. The improvement according to claim 3 and further comprising a flat sliding surface on the side of each mouth-like opening adjacent the free end of each crank lever extending at an angle, between a line perpendicular to said sliding surface of said opening and a line extending from the mouth-like opening to the pivot point of the pivotal mounting of said lever, in the range of 40° to 60°.

5. The improvement according to claim 2, 3 or 4 wherein said means to pivotally connect each respective crank lever short arm to the respective crank lever drive means comprises a respective tie rod, and further comprising a plurality of guide pulleys pivotally mounted on each tie rod and on said push rod, a sensing device mounted on said push rod and an elongated flexible member attached at one end to said push rod and at the other end to said sensing device and extending over said pulleys so that differential movement of said tie rods with respect to each other will cause said flexible member to move and operate the sensing device.

6. The improvement according to claim 1, 2, 3 or 4 and further comprising striker plates mounted on the inner surfaces of said gripping jaws between said jaws and the inner surface of the gripping head mouth.

7. The improvement according to claim 1, 2, 3 or 4, and further comprising striker plates mounted on the inner end surfaces of said gripping mouth adjacent the inner surfaces of said jaws to receive the impact of said jaws during rapid retraction thereof.

8. The improvement as claimed in claim 5 wherein said elongated flexible member is a traction cable, said one end is adjacent the end of said push rod adjacent said crank levers, said sensing device is mounted on the end of said push rod adjacent said drive means, said guide pulleys are mounted between said ends of the traction cable, a first guide pulley is mounted on one tie rod adjacent said one end, a second guide pulley is mounted on another tie rod, a third guide pulley is mounted on said push rod offset from the longitudinal center line thereof, a fourth guide pulley is mounted on said push rod substantially near said longitudinal center line, and said sensing device is a potentiometer operatively connected to said other end of said traction cable, said guide pulleys being positioned with respect to each other so that when said tie rods move synthronously there is no movement of the potentiometer and relative movement of said tie rods with respect to each other will cause movement of the potentiometer.

9. The improvement as claimed in claim 2 wherein said cam member comprises an extension on each jaw having a part circular outer peripheral configuration.

10. In a plate stretcher comprising a gripping head having a griping mouth, at least one pair of plate-gripping jaws in the gripping mouth, V-form guide means in which the jaws are slidable, and means for sliding the jaws relative to the guide means synchronously forwards for closing the jaws and backwards for opening the jaws, the improvement wherein said means for sliding said jaws comprises, driving means and, for each jaw of said pair of jaws, a respective coupling member operatively positioned to be in compression between said driving means and the associated jaw during forward movement for moving said jaw forwards to close the jaws, said coupling member being releasably operatively associated with said jaw so that said coupling member is separable from said jaw during operation of the plate stretcher, and means for moving each coupling member between a first position wherein said coupling member is in operating relationship with a respective jaw and a second position wherein said coupling member is in nonoperating relationship with a respective jaw and clear of the region of movement of said jaw so that said jaw is movable separately and independently of said coupling member.

11. The improvement as claimed in claim 10 and further comprising recoil-absorbing means mounted at the inner end of the gripping mouth in position to receive the impact of said jaws during rapid retraction thereof.

* * * * *

UNITED STATES PATENT AND TRADEMARK OFFICE

CERTIFICATE OF CORRECTION

PATENT NO. : 4,492,105

DATED : January 8, 1985

INVENTOR(S) : KUTZ et al.

Figure 11A:
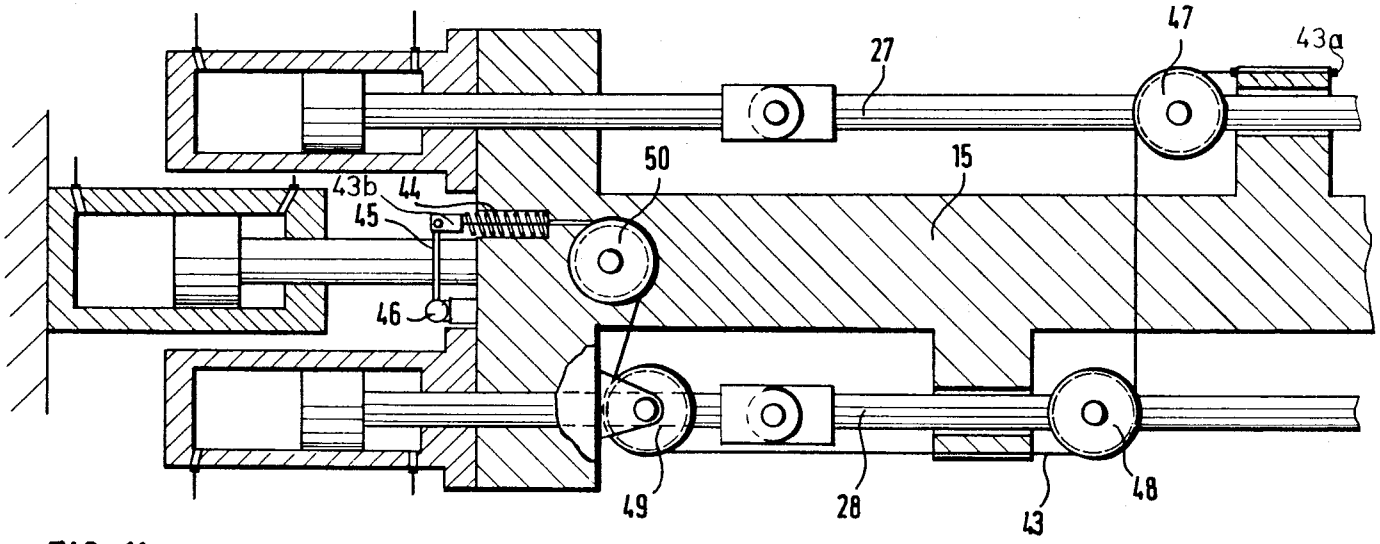
FIG. 11*a* is a diagrammatic cross-sectional view of part of the device showing an alarm device in the normal position.
Figure 11B:
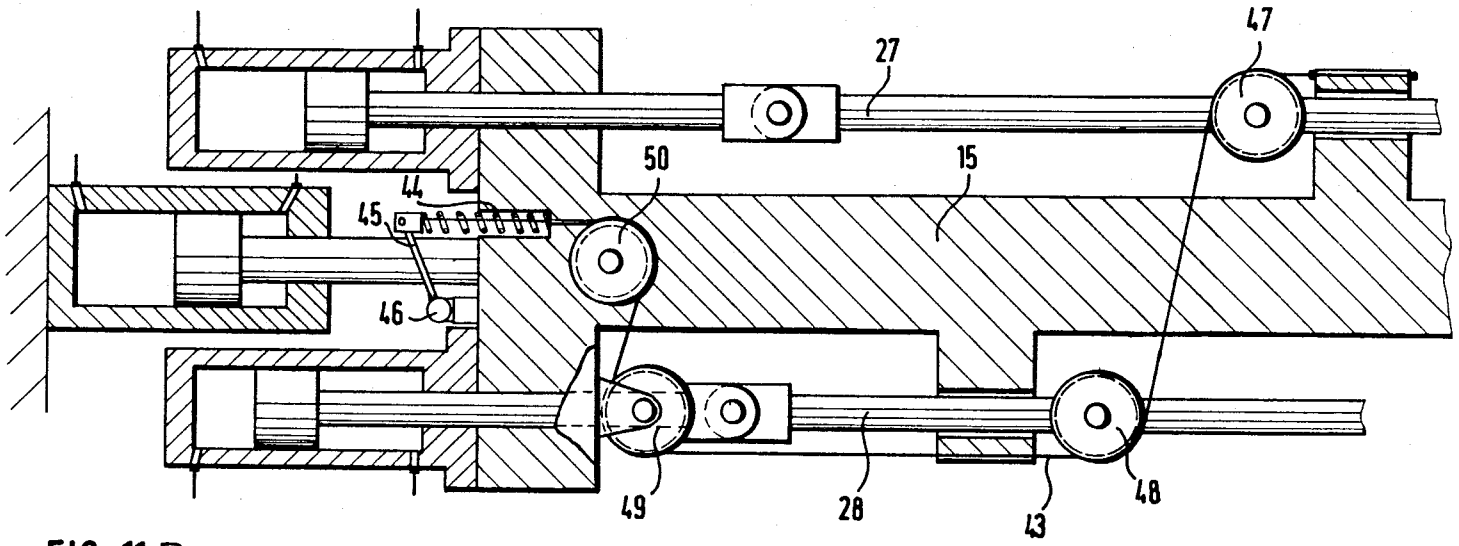
FIG. 11*b* is a view similar to FIG. 11*a* showing the alarm in an actuated position.

It is certified that error appears in the above—identified patent and that said Letters Patent is hereby corrected as shown below: Figures 11a and 11b have been corrected to appear as below.

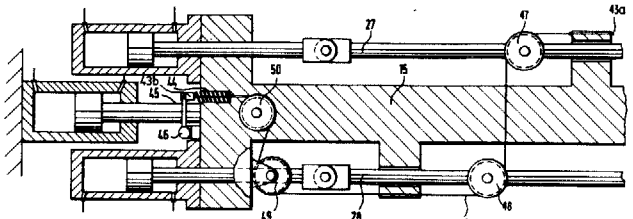

FIG. 11A

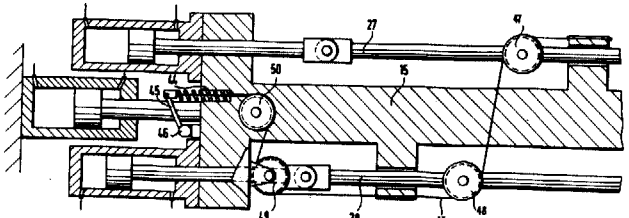

FIG. 11B

Signed and Sealed this

*Thirty-first* Day of *December 1985*

[SEAL]

*Attest:*

DONALD J. QUIGG

*Attesting Officer*

*Commissioner of Patents and Trademarks*